US007905359B2

(12) United States Patent
Gnann et al.

(10) Patent No.: US 7,905,359 B2
(45) Date of Patent: Mar. 15, 2011

(54) DEVICE FOR DELIVERING BULK MATERIAL STORED IN A SUPPLY CONTAINER

(75) Inventors: Kurt Gnann, Biberach (DE); Harald Mauz, Ehingen (DE)

(73) Assignee: Uhlmann Pack-Systeme GmbH & Co. KG, Laupheim (DE)

( * ) Notice: Subject to any disclaimer, the term of this patent is extended or adjusted under 35 U.S.C. 154(b) by 0 days.

(21) Appl. No.: 12/422,734

(22) Filed: Apr. 13, 2009

(65) Prior Publication Data

US 2009/0255858 A1 Oct. 15, 2009

(30) Foreign Application Priority Data

Apr. 14, 2008 (EP) ..... 08007282

(51) Int. Cl.
*B07B 13/00* (2006.01)
*B07C 5/12* (2006.01)

(52) U.S. Cl. ..... 209/682; 209/409; 209/412; 53/244; 53/539

(58) Field of Classification Search ..... 209/409, 209/412, 659, 680, 682; 53/244, 539
See application file for complete search history.

(56) References Cited

U.S. PATENT DOCUMENTS

| | | | | |
|---|---|---|---|---|
| 7,328,557 | B2 * | 2/2008 | Gertitschke et al. | 53/539 |
| 7,565,781 | B2 * | 7/2009 | Krahl et al. | 53/158 |
| 2004/0074818 | A1 * | 4/2004 | Burnett | 209/405 |
| 2007/0261368 | A1 | 11/2007 | Krahl et al. | |

FOREIGN PATENT DOCUMENTS

| | | |
|---|---|---|
| DE | 10 2005 049 882 | 2/2007 |
| EP | 1 854 722 | 11/2007 |

* cited by examiner

*Primary Examiner* — Terrell H Matthews
(74) *Attorney, Agent, or Firm* — Cohen Pontani Lieberman & Pavane LLP

(57) ABSTRACT

The device for delivering bulk material consisting of individual products has a supply container for storing the individual products. A perforated plate is arranged downstream of the product outlet of the supply container on a base stand and serves to receive the individual products from the product outlet and to move them further in a transport direction while removing broken products and dust. A clamping strip is supported and removably fixed in a motion guideway of a motion guideway carrier mounted on the base stand. The motion guideway extends at an angle to a vertical direction. The clamping strip thus removably fixes the perforated plate to the base stand.

8 Claims, 15 Drawing Sheets

DEVICE FOR DELIVERING BULK MATERIAL STORED IN A SUPPLY CONTAINER

BACKGROUND OF THE INVENTION

1. Field of the Invention

The invention pertains to a device for delivering bulk material consisting of individual products stored in a supply container to a transfer unit, which transfers the individual products into the pockets of a continuously or cyclically moving web of sheeting. The device is provided with a perforated plate arranged replaceably downstream of the product outlet of the supply container on a base stand.

2. Description of the Related Art

These types of devices are known in practice. They are used in conjunction with thermoforming machines as part of the filling station, which effectively loads the individual products at high speed into the pockets in the web of sheeting which have been created in preceding work stations of the thermoforming machine. This requires that the individual products, made available as bulk material, be individuated, for which purpose the individual products are dispensed from the supply container through the product outlet onto the perforated plate. The holes of the perforated plate are adapted to the size of the individual products in such a way that intact, undamaged individual products remain on the perforated plate, whereas dust and breakage are discharged through the holes.

The dependence of the size of the holes of the perforated plate on the size of the individual products means that the perforated plate must be a so-called "format" part, i.e., it must be replaced whenever the "format" of the product changes. In the case of the previously known devices, clamping screws acting on one of the long sides of the perforated plate press the other long side of the plate against a strip, which is provided with a groove for the positioning of the perforated plate. This makes cleaning difficult, and in the case of large perforated plates, it also leads to the problem of insufficient rigidity. The latter problem can be partially solved by increasing the thickness of the plate which in turn is associated with a significant increase in weight making it more difficult to replace the plate.

SUMMARY OF THE INVENTION

It is an object of the present invention to provide a device of the type indicated above which is easier to clean and where it is also easier to replace the perforated plate.

According to one aspect of the invention, the device for delivering bulk material consisting of individual products comprises a supply container for storing the bulk material of individual products, the supply container having a product outlet; at least one perforated plate arranged downstream of the product outlet of the supply container on a base stand, the at least one perforated plate serving to receive the individual products from the product outlet and to move them further in a transport direction while removing broken products and dust; at least one clamping strip supported and removably fixed in a motion guideway of a motion guideway carrier mounted on the base stand, the motion guideway extending at an angle to a vertical direction, the at least one clamping strip thus removably fixing the at least one perforated plate to the base stand.

As a result of this design, a first advantage is obtained that there is no need for any force to be exerted on the long sides of the plate to hold the perforated plate on the base stand, since such force could lead to the deformation of the perforated plate. Instead, because the clamping strip is guided and removably fixed in the motion guideway, the strip is able to apply force in the vertical direction in the manner defined by the orientation of the motion guideway. Because the perforated plate is acted upon from above, there is no need for a groove or other holder with a positive connection for the perforated plate, which means that the surfaces are almost completely smooth and thus easy to clean.

So that the perforated plate can be detached from the base stand in the easiest way possible, the design is selected so that the motion guideway is formed as a guide slot, which is open at one end and into which a guide pin of the clamping strip can thus be inserted.

To fix the clamping strip in position with respect to the base stand, it is also provided that the clamping strip comprises a clamping means to clamp the clamping strip to the base stand. A simple and elegant way of pressing the clamping strip down onto the perforated plate and thus the perforated plate against the base stand is to use a clamping screw as the clamping means, which is guided downward at an angle to the vertical by a screw block mounted on the base stand. The angle of the motion guideway can preferably be the same as the angle of the clamping screw. This guarantees that, when the clamping screw displaces the clamping strip in the motion guideway in the longitudinal direction of the perforated plate, a downward-directed component is also produced at the same time, so that both ends of the clamping strip are guided downward and pressed against the perforated plate.

With respect to the ease with which the various parts can be cleaned, it has been found favorable for the clamping screw to be connected detachably to the clamping strip.

It is also advantageous to provide several clamping strips in an arrangement assigned to the lateral edges of the perforated plate, because in this way the perforated plate can be forced to lie flat on the base stand without any danger of tilting.

It is quite especially preferred to provide several perforated plates and to arrange them in a row perpendicular to the transport direction, because, as a result of this measure, a large effective width of the device can be obtained. This modular approach makes it easy to increase the output of the device.

The simplest way to deliver the individual products to be conveyed from the product outlet to the transfer unit is to arrange the base stand so that it slants down in the transport direction. Alternatively or in addition to that, at least one vibratory drive can be assigned to the base stand to transport the products along the perforated plate from the product outlet to the transfer unit.

To simplify the handling of the perforated plate when it needs to be replaced, it may be provided, in the case of a perforated plate with a plurality of holes adapted to the diameter and to the shape of the individual products, that stiffening ribs, which divide the perforated plate into separate areas, are formed on the side facing away from the individual products, wherein the holes are present only in the areas of the plate located between the stiffening ribs. This design makes it more difficult to produce the perforated plate, since the holes must be produced after the ribs have been formed or at least after it has been decided where they will go. However, a perforated plate of this type offers good stiffness and is low in weight. To improve the stiffness, the stiffening ribs intersect each other. The plate areas are then in the form of rectangles, in which the holes can be placed as a function of the size and shape of the individual products to make optimal use of the surface area available in the sense of the densest possible packing.

Support surfaces without stiffening ribs may be provided at the leading and/or trailing ends (with respect to the transport direction) of the perforated plate to make it possible for the plate to rest reliably on the base stand and to provide an area where the vibratory drive can be connected.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is explained in greater detail below on the basis of an exemplary embodiment, which is illustrated in the drawings.

DETAILED DESCRIPTION OF THE PRESENTLY PREFERRED EMBODIMENTS

Thermoforming machines are used especially in the pharmaceutical industry to package individual products such as tablets, dragées, pills, or the like in blister packs, for which purpose thermoplastic sheet is pulled in the form of a web of sheeting from a supply roll in the thermoforming machine and sent to a heating station, in which the thermoplastic sheet is heated to the preforming temperature, and then to a forming station, in which the pockets of the blister packs are formed. In order to facilitate the filling of the pockets in the web of sheeting, the device according to the invention serves as a connecting element between a product supply and a transfer unit, which transfers the individual products into the pockets in the web of sheeting.

Figure 1:
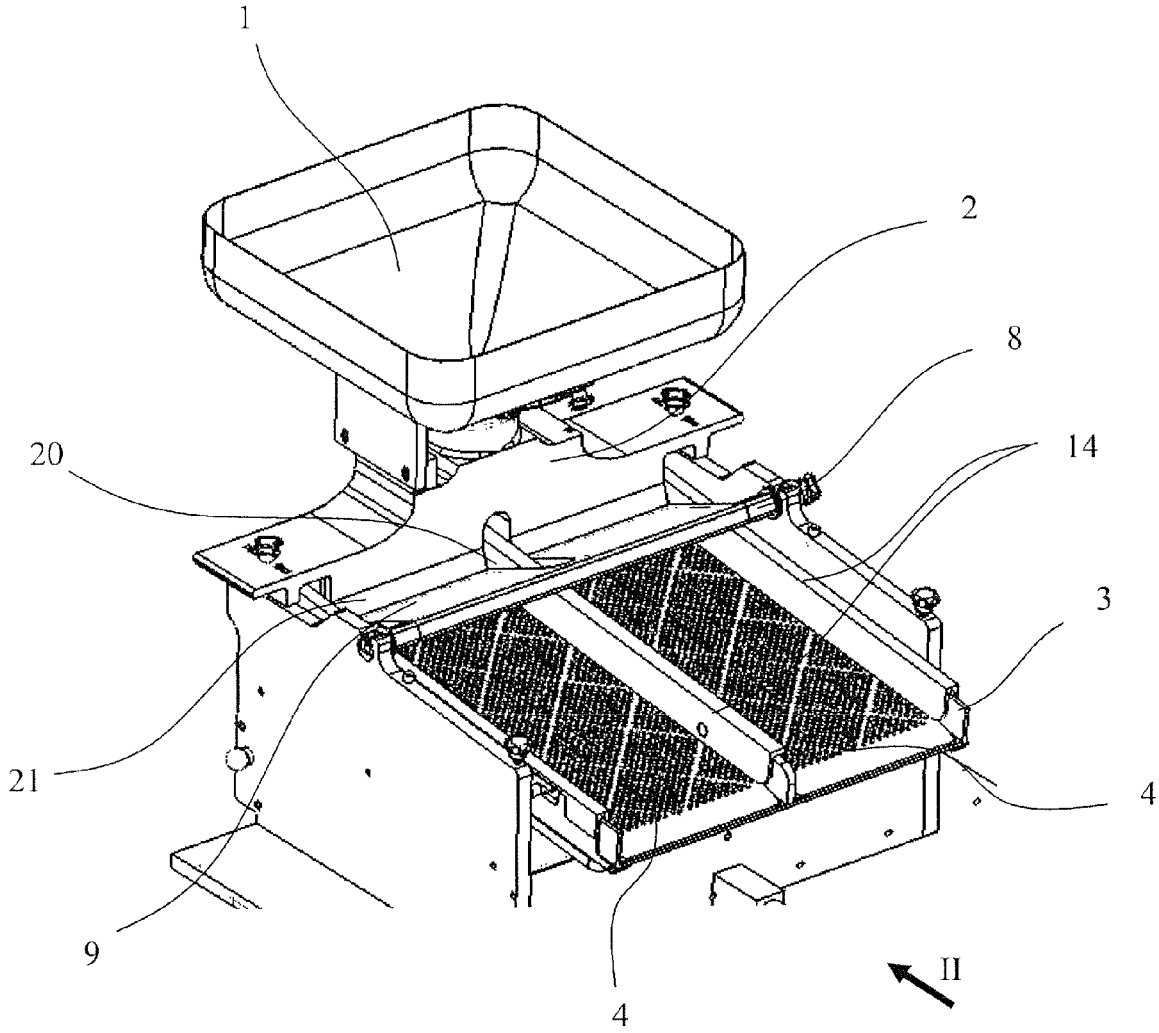
FIG. 1 is a perspective view of one embodiment of the device according to the invention.
Figure 2:
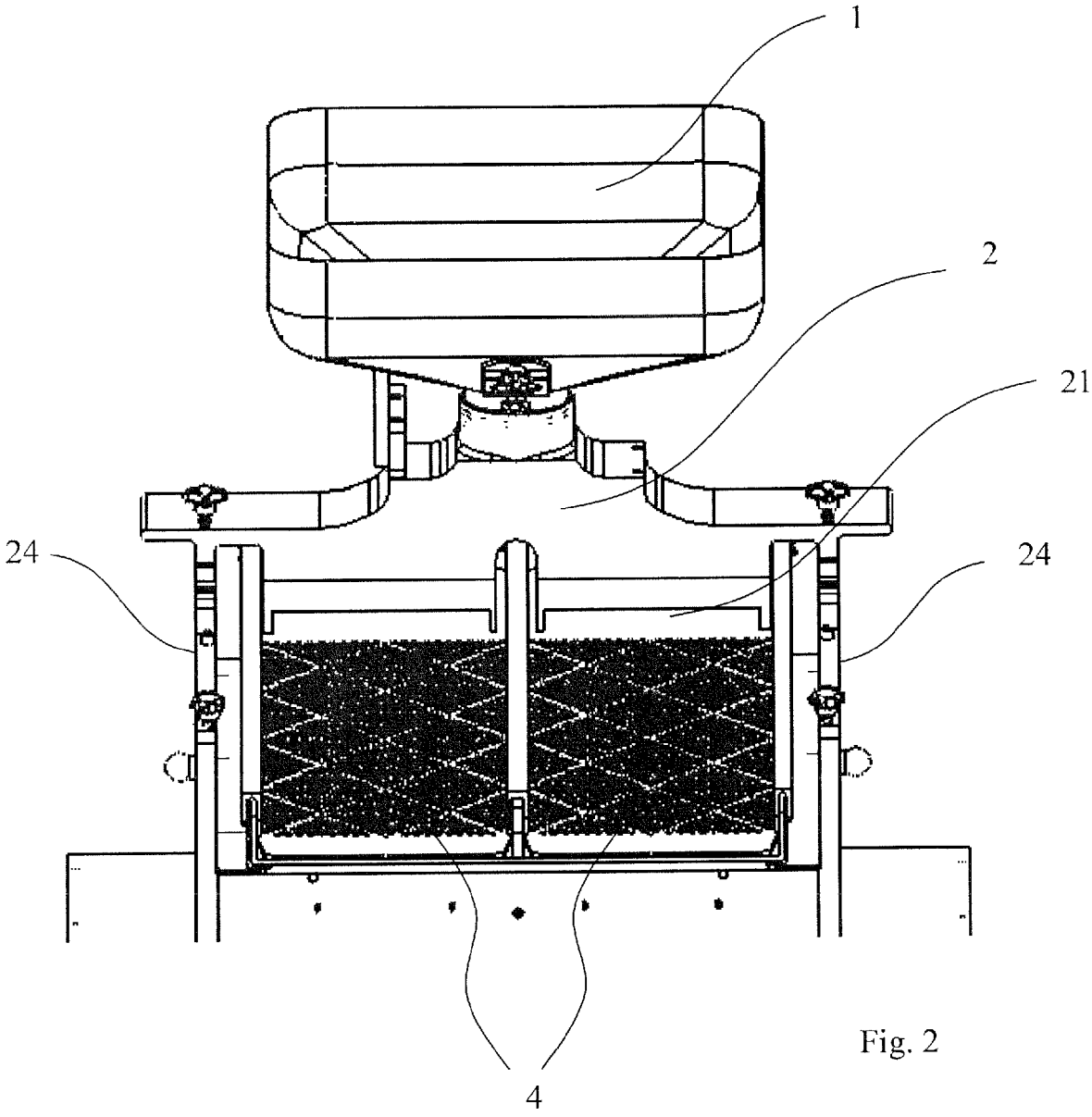
FIG. 2 is a view in the direction of the arrow 11 in FIG. 1.

FIGS. 1 and 2 show the device, which comprises for this purpose not only the supply container 1 with its product outlet 2 but also a perforated plate 4, which is mounted detachably and replaceably downstream from the product outlet 2, in a plate holder 3 of a base stand 24. In the exemplary embodiment shown here, several of these perforated plates 4 are present, specifically two of them arranged in a row perpendicular to the transport direction of the individual products, so that as a result a large effective width of the device is obtained by very simple means.

Figure 7A:
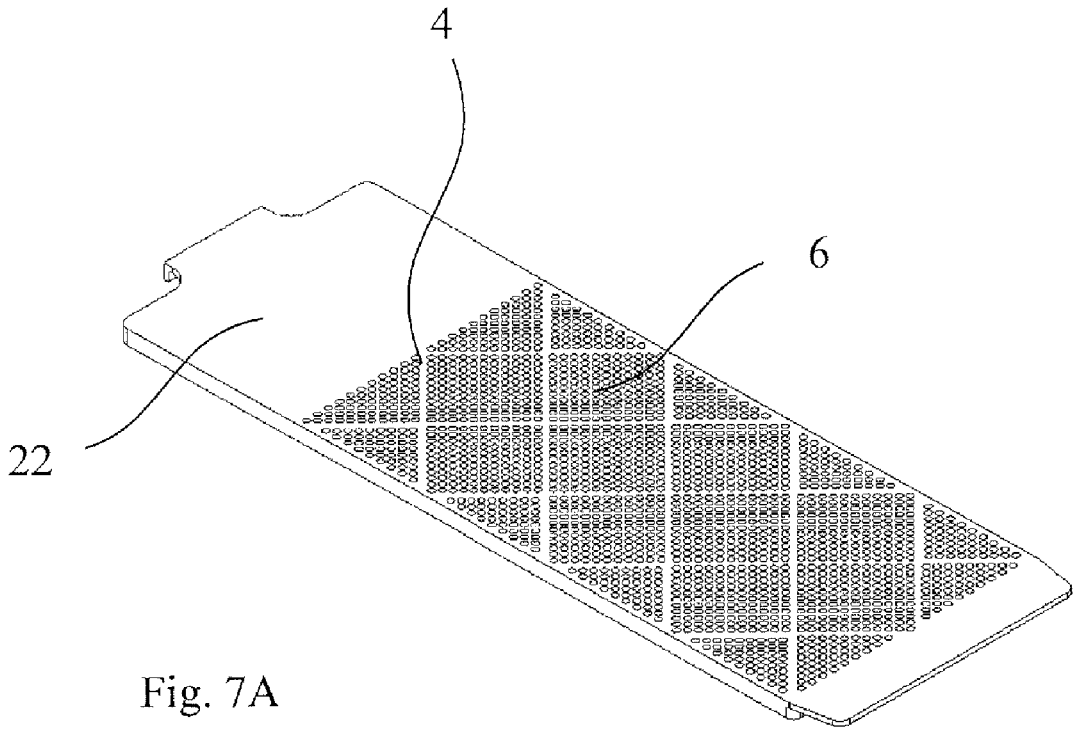
FIG. 7*a* is a perspective view of the perforated plate from above.
Figure 7B:
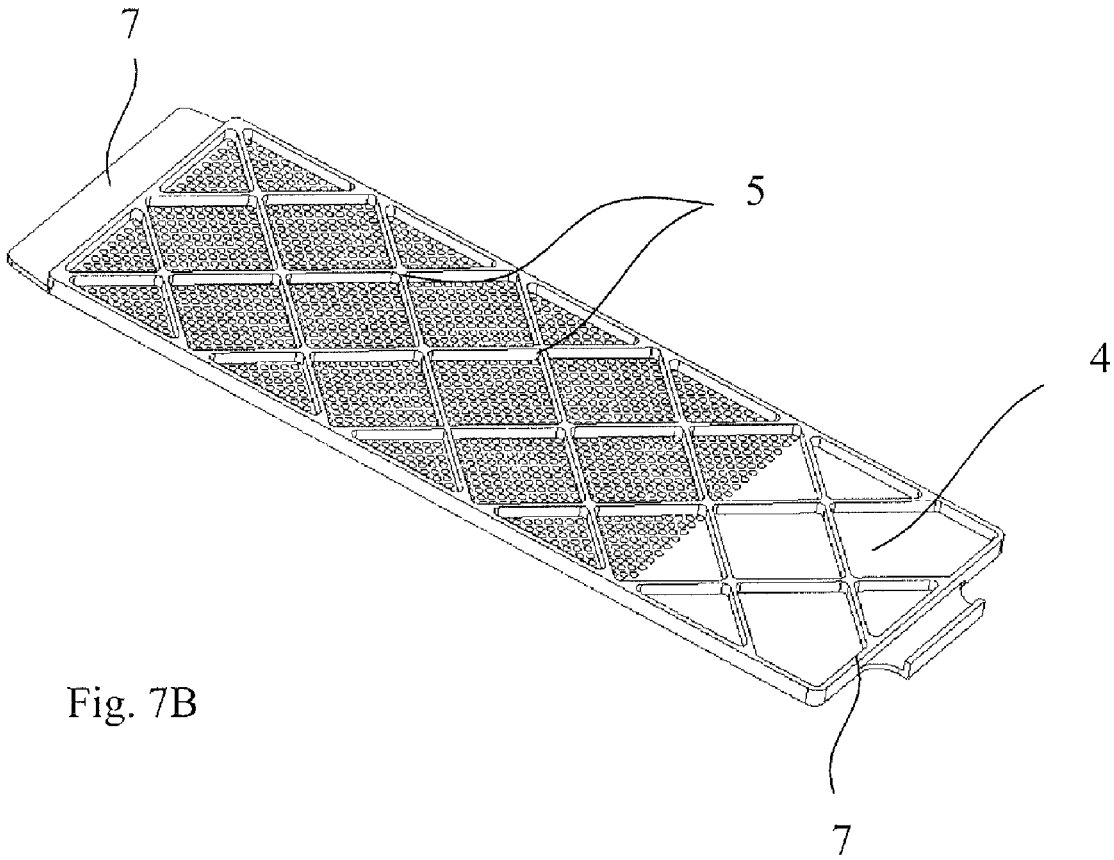
FIG. 7*b* is a perspective view of the perforated plate from below.

Each perforated plate 4 comprises a plurality of holes adapted to the diameter and the shape of the individual products. The holes hold back intact individual products on the surface of the perforated plate 4 but allow breakage and dust to pass through. On the side of the perforated plates 4 facing away from the individual products are stiffening ribs 5 (FIG. 7*b*), which slant inward from the opposing lateral edges and divide the rectangular perforated plate 4 into separate areas 6, wherein the holes are formed only in the areas 6 of the perforated plate 4 between the stiffening ribs 5. Support surfaces 7 without stiffening ribs 5 may be provided at the leading and trailing ends (with respect to the transport direction) of the perforated plates 4. These support surfaces allow the perforated plate 4 to lie in a defined position in the base stand 24 and also make it easier to connect the vibratory drive provided to convey the products from the product outlet 2 to the transfer unit (not shown). Because the plurality of perforated plates 4 can be arranged in a single base stand 24, one vibratory drive is usually sufficient, which offers a corresponding cost advantage. In addition, to support the action of the vibratory drive, it is also possible, of course, for the base stand 24 to slant downward in the transport direction so as to take advantage of the force of gravity.

The surface area directly under the product outlet 2 cannot be used to separate breakage, i.e., it should not have any holes in it, because the individual products lying on the perforated plate 4 would be pressed onto the perforated plate 4 and against the edges of the holes by the product column lying on top of them, and the vibratory movements of the perforated plate 4 could thus damage the individual products.

Figure 8:
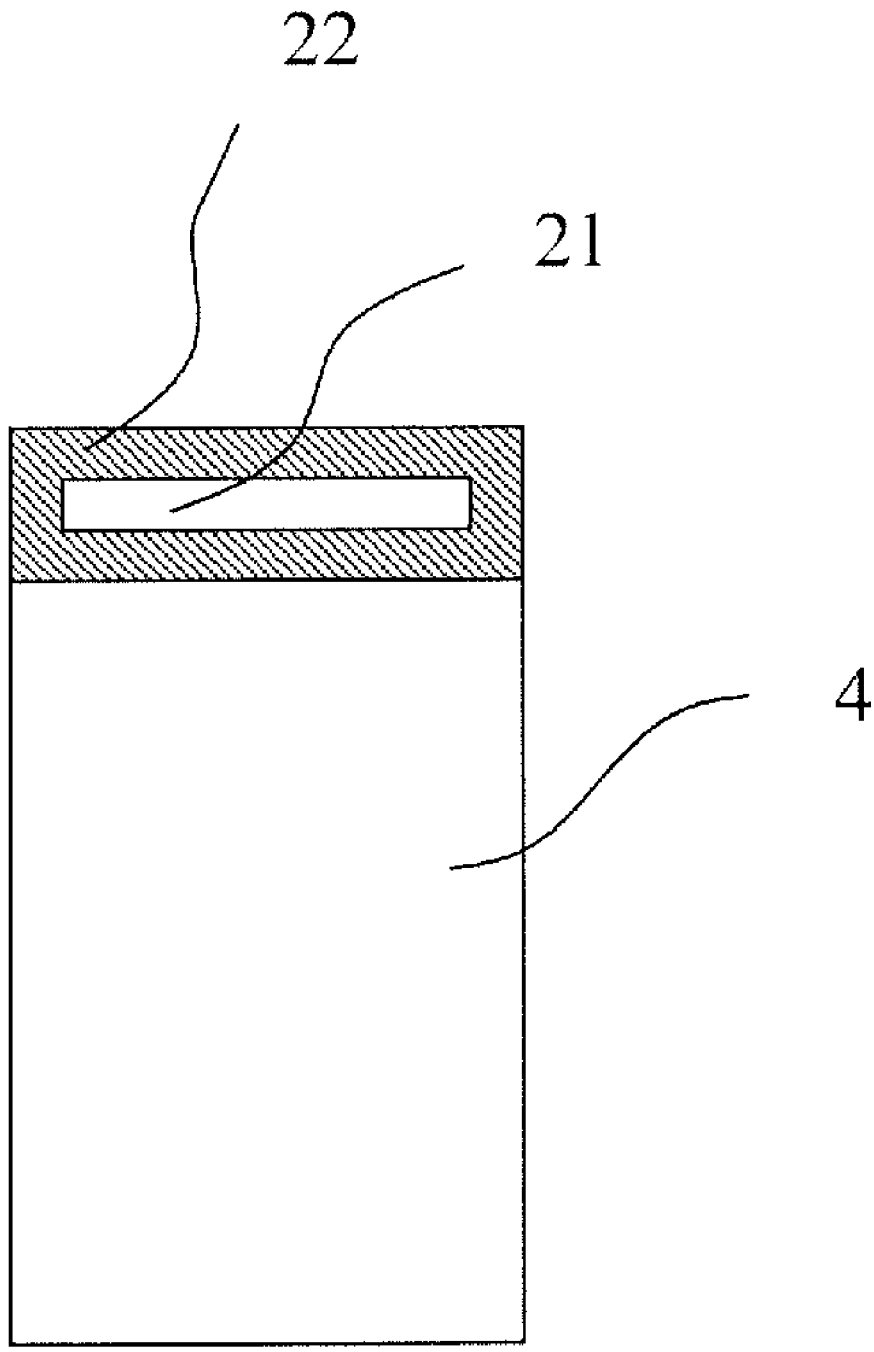
FIG. 8 is a schematic top view of the perforated plate including a sketch of the outlet opening of the supply container and the product inlet surface of the perforated plate.

The general boundary conditions are that the device should occupy the smallest possible amount of space and have the highest possible output at the same time. A contribution toward achieving both of these objects is provided in that the outlet opening 21 of the product outlet 2 comprises a basic shape oriented around a rectangle with a width approximately the same as that of the perforated plate 4 and a length, i.e., a dimension in the transport direction of the individual products, adapted to the size of the individual products. The perforated plate 4 comprises, underneath the product outlet 2, a hole-free product inlet surface 22 (see FIG. 3) corresponding to the length of the outlet opening 21. It is therefore provided in the device that as much of the width of the perforated plate 4 as possible is used for product distribution when the individual products are deposited onto the perforated plate 4, which means that outlet opening 21 of the product outlet 2 is adapted to this requirement. Choosing an appropriate shape for the outlet opening 21, namely, a skinny rectangle, makes it possible to reduce the length of the hole-free area of the perforated plate 4, that is, the length of the product inlet surface 22, and therefore to minimize the area which does not contribute to breakage separation. When the individual products are delivered through a small round outlet opening according to the prior art, they must travel a longer distance in the transport direction before they can spread out evenly from the edges of the product outlet 21 to the edges of the perforated plate 4, whereas, when the products are delivered through the rectangular opening (FIG. 8), they become evenly distributed from edge to edge after traveling a much shorter distance. It has been found favorable for the outlet opening 21 to be rectangular in design with a width equal to 60-95%, preferably 75-85%, of the width of the perforated plate 4 and with a length corresponding to 2-12 times, especially 5-8 times, the size of the products, wherein the product inlet surface 22 comprises 3-8 times the size of the outlet opening 21.

Figure 9:
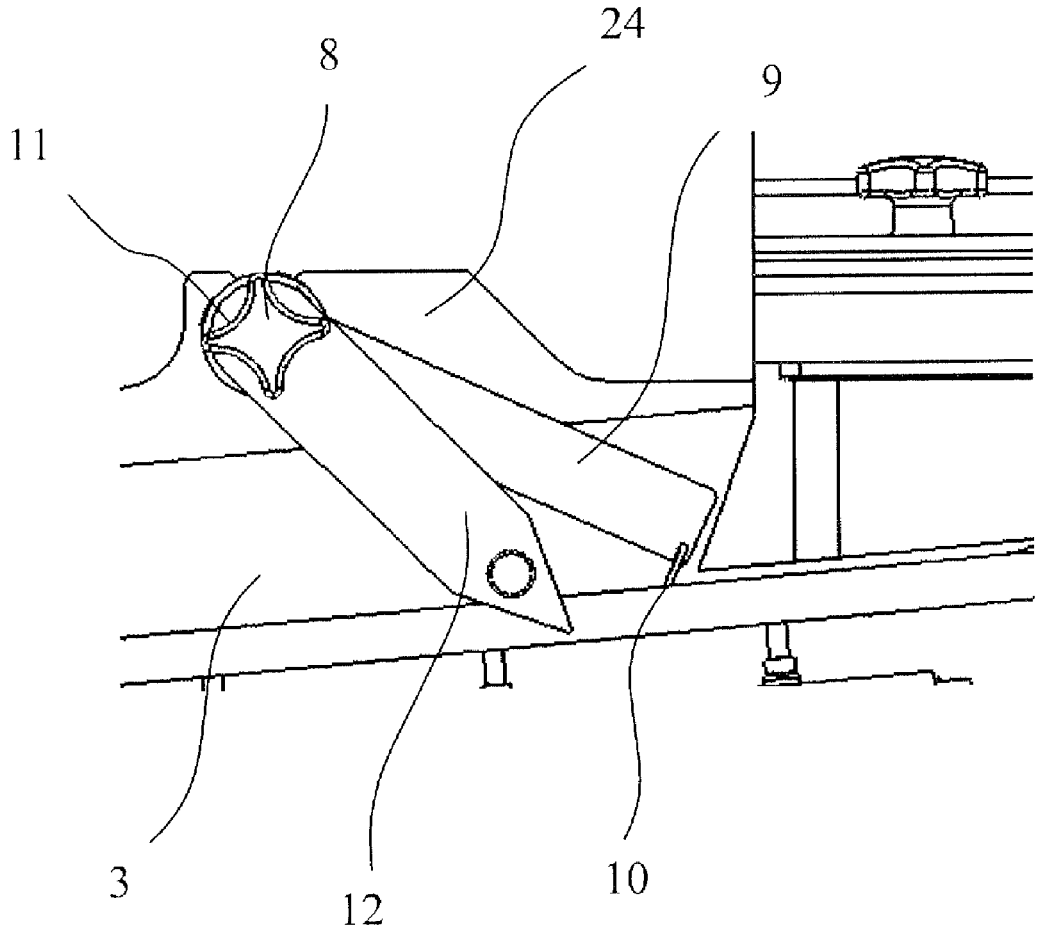
FIG. 9 is a side view of the plate holder with a bulk material leveler in a first rotational position.
Figure 10:
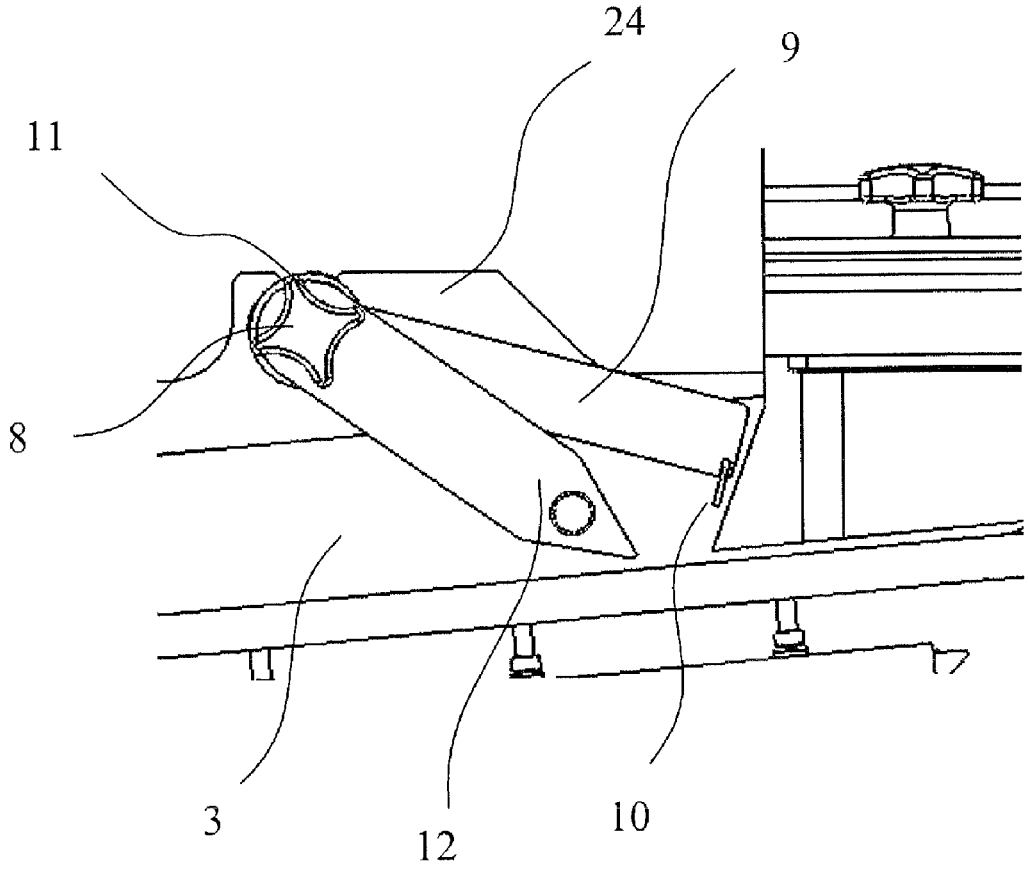
FIG. 10 is a view corresponding to FIG. 9 with the bulk material leveler in a second rotational position.
Figure 11:
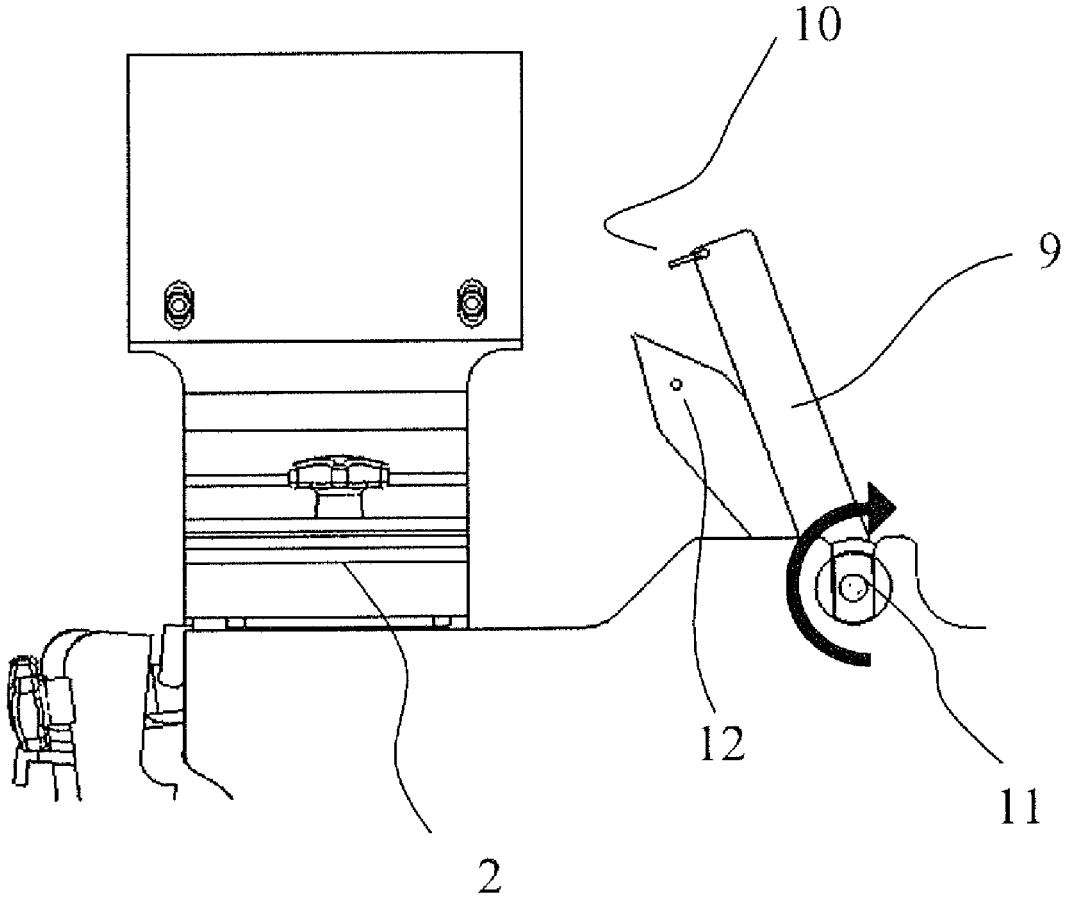
FIG. 11 is a view of the preparation for the removal of the bulk material leveler.
Figure 12:
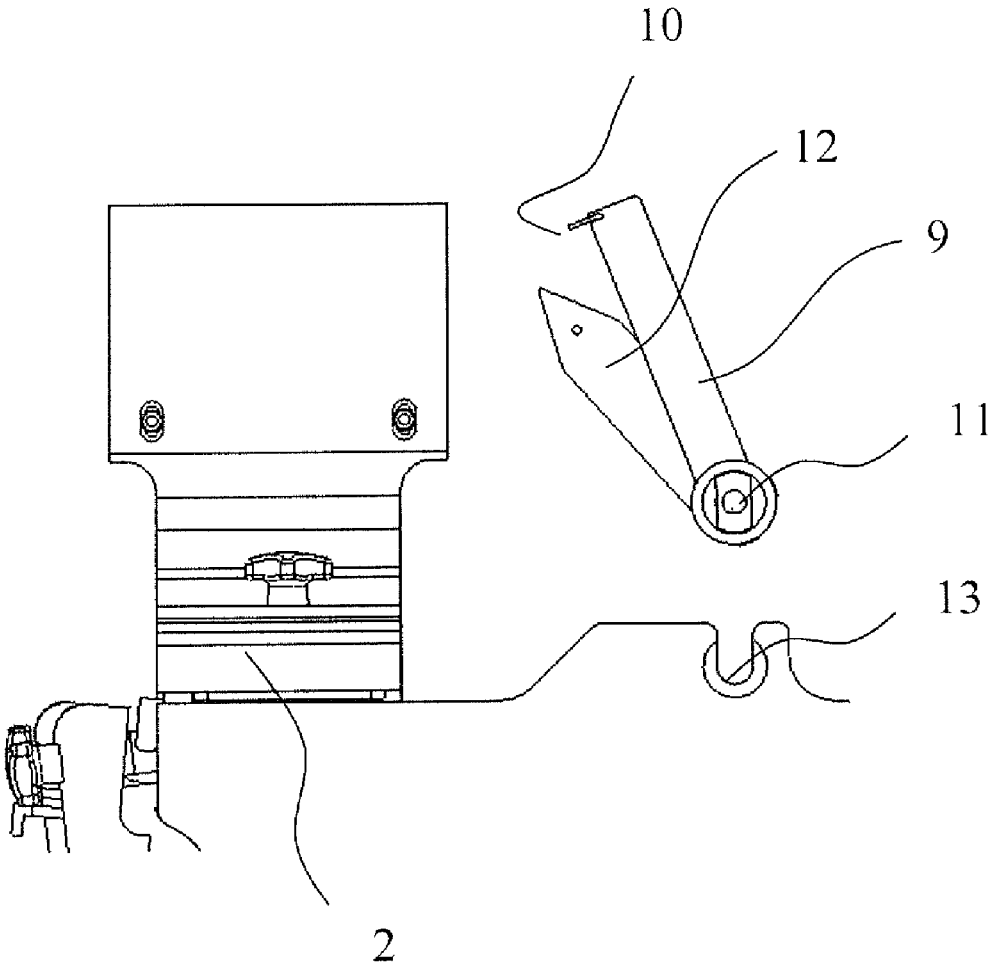
FIG. 12 is a view corresponding to FIG. 11 after the bulk material leveler has been removed from the plate holder.

When the individual products are transferred from the supply container 1 to the transfer unit, it is important for the individual products to form a layer on the perforated plate 4 which is only one deep. Therefore, downstream from the product outlet 2, above the perforated plate 4, a bulk material leveler 9 is mounted rotatably on a pivot axis 8 (FIG. 9). So that the perforated plates 4 located underneath the bulk material leveler 9 can be replaced, the leveler is connected detachably to the base stand 24. The bulk material leveler 9 comprises an elastic lip 10 on its free end facing the perforated plate 4 to ensure that the individual products are treated gently. The rotational position of the bulk material leveler 9 itself can be set by means of a positioning element 11, namely, a clamping screw with a T-handle, so that the leveler can be adjusted to suit the size of the individual products (FIG. 10). An adjusting lever 12 is provided on the clamping screw itself. When the type of the individual products to be packaged in the pockets of the web of sheeting is to be changed, it is also necessary to replace the old perforated plate with a new one with holes adapted to the size and shape of the new individual products, so that, to achieve the shortest possible setup time for the device, it should be possible to accomplish such a change easily, quickly, and by a single person if at all possible. To replace the perforated plates 4, therefore, first the clamping screw is loosened, and then the adjusting lever 12 is used to rotate the bulk material leveler 9 (FIG. 11) in such a way that it can be removed by pulling it upward out of its screw receiving groove 13 (FIG. 12), which is open in the upward direction.

Figure 5:
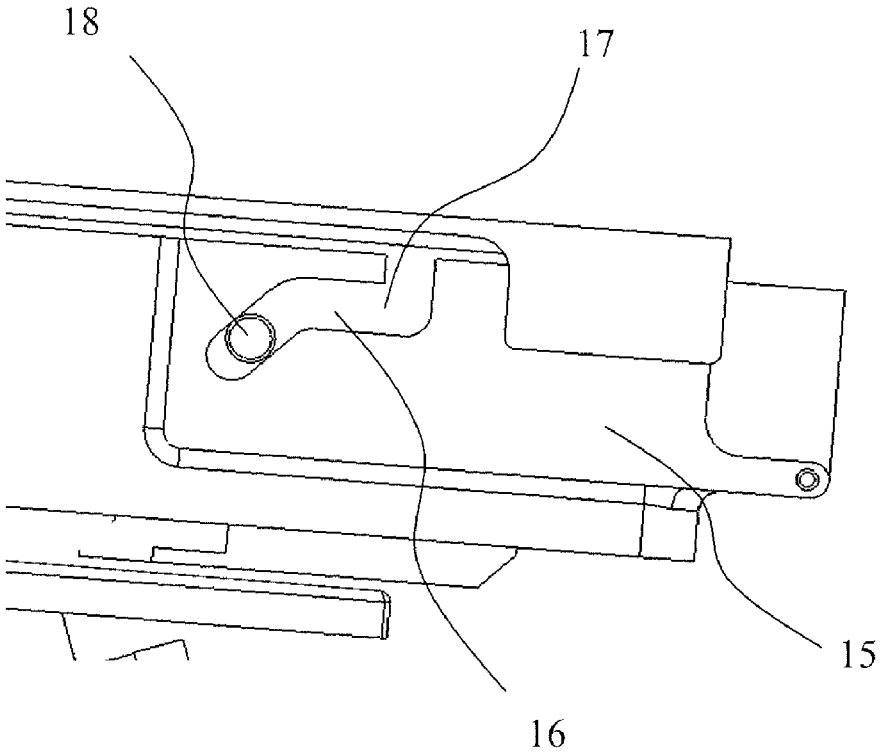
FIG. 5 is an enlarged side view of the detail marked "V" in FIG. 3.
Figure 6A:
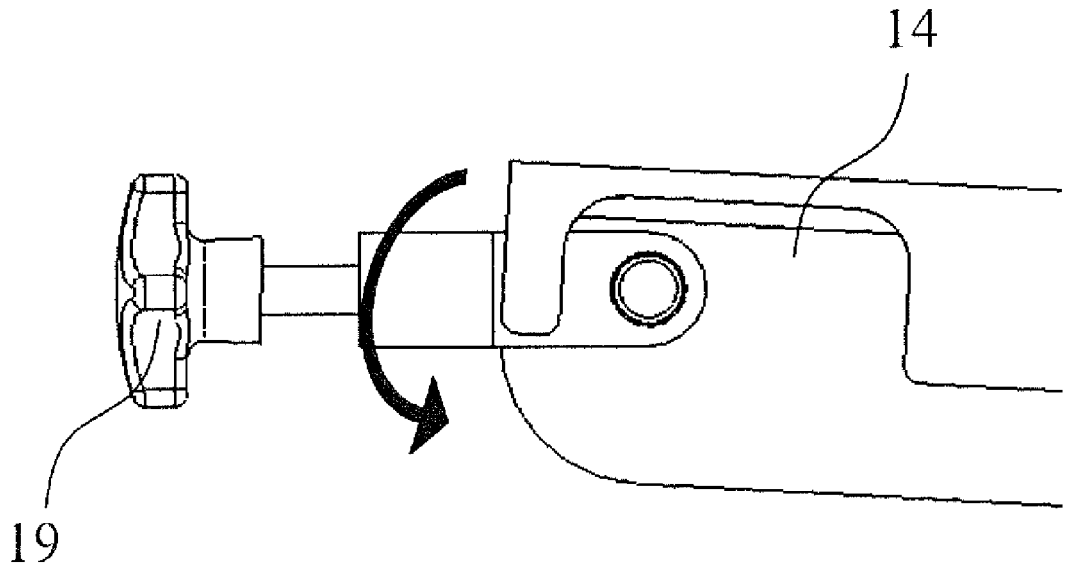
FIGS. 6*a*-6*c* are three side views showing the separation of the clamping screw from the clamping strip.
Figure 6B:
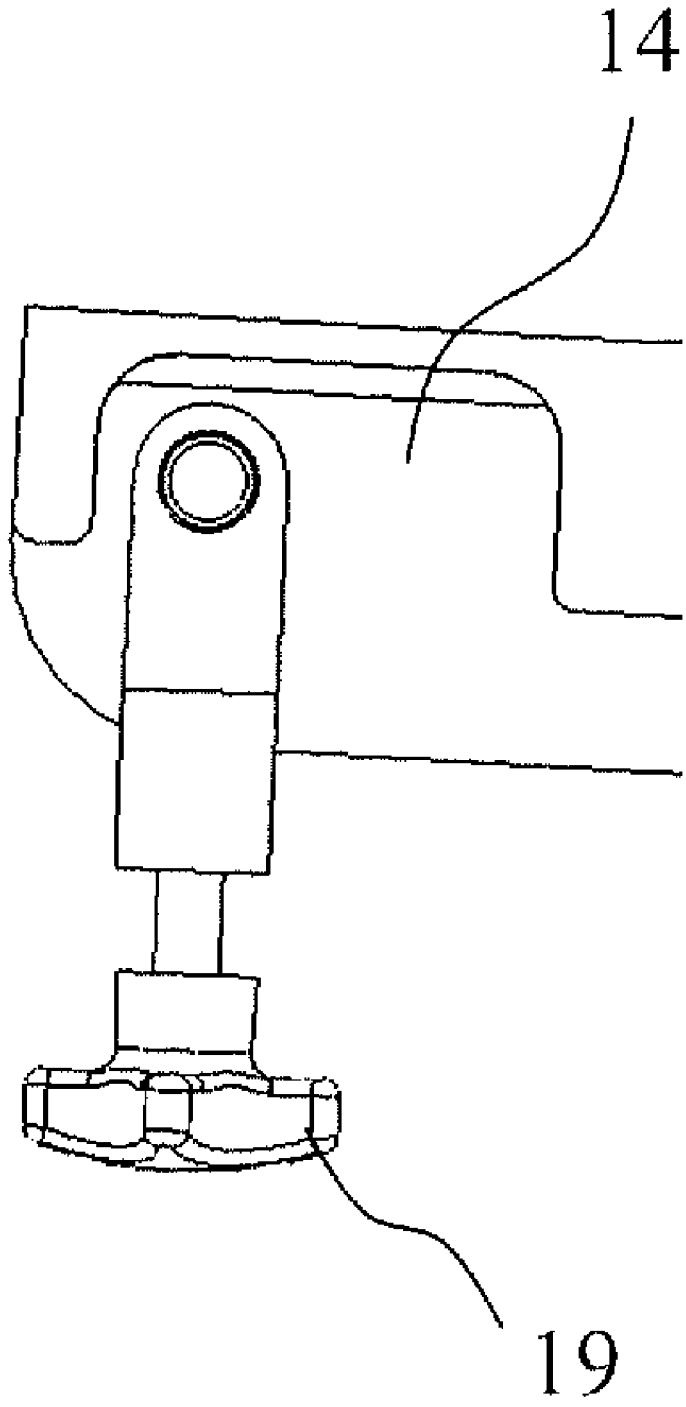
Figure 6C:
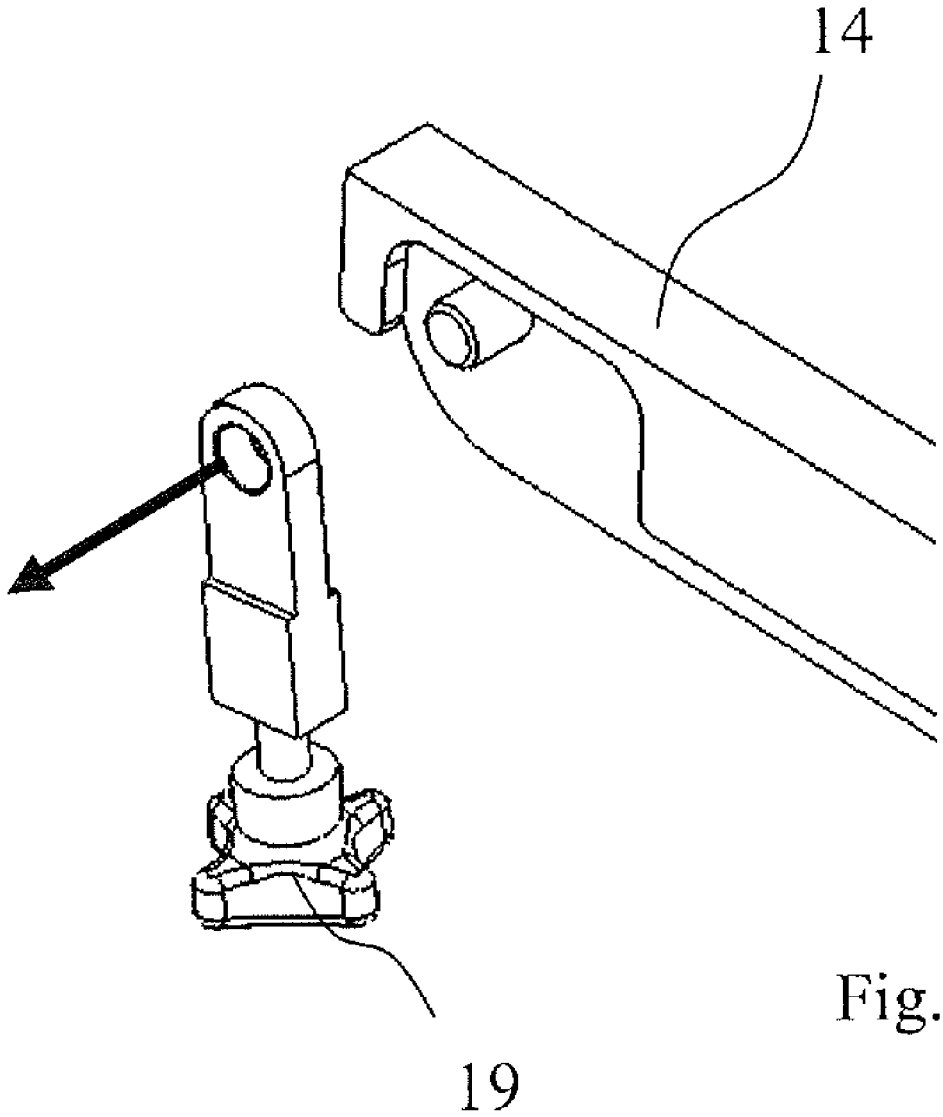

The reason that the perforated plates 4 can be replaced easily is that the plate holders 3 on which the clamping strips 14 are arranged are designed as motion guideway carriers 15 (FIG. 5). Each clamping strip 14 is supported in a motion guideway 16 of the motion guideway carrier 15. The motion guideway 16 extends at an angle to the vertical and is formed as a guide slot 17, which is open at one end and into which the guide pin 18 of the clamping strip 14 can thus be inserted. At the end of the clamping strip 14 near the product inlet surface 22, a clamping means, preferably a clamping screw 19, is provided, which engages in a screw block 23, which extends downward at an angle to the vertical. The angle of the motion guideway 16 may preferably correspond to the angle of the clamping screw 19, so that, when the clamping screws 19 are turned in the clamping direction, the clamping strip 14 as a whole is pulled downward at this same angle and the perforated plate 4 is thus clamped to the plate holder 3 and thus the base stand 24. To make it even easier to clean the device, the clamping screw 19 may be connected detachably to the clamping strip 14 (FIGS. 6*a*-6*c*). However, apart from the preferred embodiment described above, a number of other clamping means for fixing the clamping strip 14 may be used as long as they provide proper and even clamping of the clamping strip 14 onto the perforated plate 4.

Figure 3:
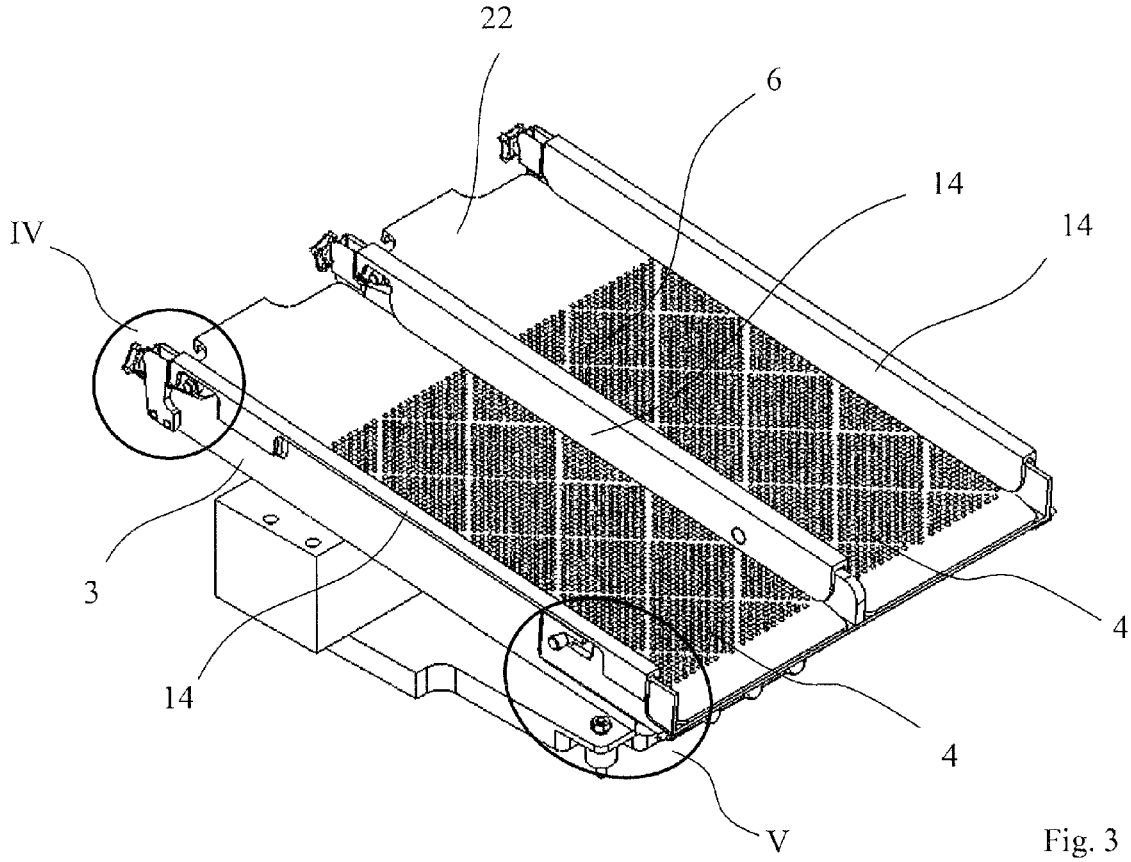
FIG. 3 is a perspective view of an isolated plate holder of a base stand with associated perforated plates and clamping strips.
Figure 4:
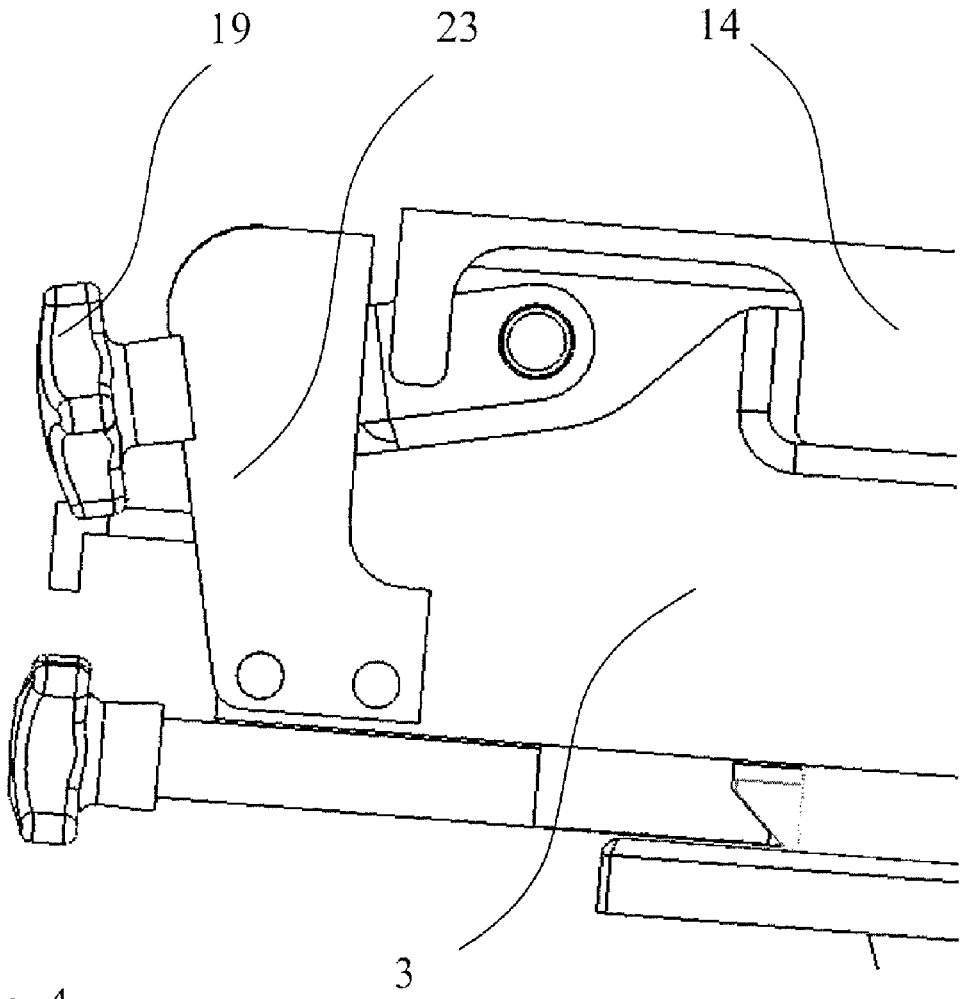
FIG. 4 is an enlarged side view of the detail marked "IV" in FIG. 3.

FIGS. 1-3 show that several clamping strips 14 are provided in an arrangement assigned to the lateral edges of the perforated plates 4. Because, in the case of the exemplary embodiment shown here, two perforated plates 4 are present, located one next to the other, the middle clamping strip 14 serves to act on two lateral edges, namely, on one of the edges of the perforated plate 4 on the left and on one of the edges of the perforated plate 4 on the right. The presence of the middle clamping strip 14 also means that an opening 20 must be provided in the bulk material leveler 9. After the leveler has been removed, the clamping screws 19 can be loosened and the clamping strips 14 pushed along the motion guideway 16, so that the guide pin 18 can be removed via the open end of the guide slot 17. The clamping strip 14 can now be removed from the plate holder 3. The perforated plates 4 are thus freely accessible and can be removed and replaced by new perforated plates 4, for which purpose it is necessary merely to reinsert the guide pins 18 of the previously cleaned clamping strips 14 into the guide slots 17 and to pivot the clamping strips 14 onto the perforated plates so that they can be clamped down again by means of the clamping screws 19.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A device for delivering bulk material consisting of individual products, the device comprising:

a supply container for storing the bulk material of individual products, the supply container having a product outlet;

at least one perforated plate arranged downstream of the product outlet of the supply container on a base stand, the at least one perforated plate serving to receive the individual products from the product outlet and to move them further in a transport direction while removing broken products and dust;

at least one clamping strip supported and removably fixed in a motion guideway of a motion guideway carrier mounted on the base stand, the motion guideway extending at an angle to a vertical direction, the at least one clamping strip thus removably fixing the at least one perforated plate to the base stand; and a clamping screw connected to the at least one clamping strip, wherein the clamping screw is guided downward at an angle to the vertical by a screw block mounted on the base stand.

2. The device according to claim 1, wherein the motion guideway is formed as a guide slot which is open at one end.

3. The device according to claim 2, wherein the at least one clamping strip comprises a guide pin inserted into the guide slot.

4. The device according to claim 1, wherein the angle of the motion guideway is the same as the angle of the clamping screw.

5. The device according to claim 1, wherein the clamping screw is detachably connected to the clamping strip.

6. The device according to claim 1, wherein two clamping strips are assigned to each of the at least one perforated plate.

7. The device according to claim 1, wherein a plurality of perforated plates are arranged in a row perpendicular to the transport direction.

8. The device according to claim 1, wherein the base stand slants downward in the transport direction.

* * * * *